US008137175B2

(12) United States Patent
Smith

(10) Patent No.: US 8,137,175 B2
(45) Date of Patent: Mar. 20, 2012

(54) PARI-MUTUEL WAGERING SYSTEM

(76) Inventor: Ernie Smith, Calabasas, CA (US)

( * ) Notice: Subject to any disclaimer, the term of this patent is extended or adjusted under 35 U.S.C. 154(b) by 1148 days.

(21) Appl. No.: 11/817,161

(22) PCT Filed: Feb. 27, 2006

(86) PCT No.: PCT/US2006/007089

§ 371 (c)(1),
(2), (4) Date: Aug. 27, 2007

(87) PCT Pub. No.: WO2006/091977

PCT Pub. Date: Aug. 31, 2006

(65) Prior Publication Data

US 2008/0254863 A1 Oct. 16, 2008

Related U.S. Application Data

(60) Provisional application No. 60/656,214, filed on Feb. 25, 2005.

(51) Int. Cl.
*A63F 9/24* (2006.01)

(52) U.S. Cl. ..... 463/16; 463/12; 463/17; 463/20; 463/42; 700/90

(58) Field of Classification Search ..... 463/12, 463/16, 17, 20, 42; 700/90
See application file for complete search history.

(56) References Cited

U.S. PATENT DOCUMENTS

| | | | | |
|---|---|---|---|---|
| 6,152,822 | A * | 11/2000 | Herbert | 463/22 |
| 6,631,473 | B2 * | 10/2003 | Townsend | 726/25 |
| 7,080,041 | B2 * | 7/2006 | Nagel | 705/51 |
| 7,152,047 | B1 * | 12/2006 | Nagel | 705/76 |
| 2002/0010022 | A1 * | 1/2002 | Vincent | 463/42 |
| 2002/0068621 | A1 * | 6/2002 | Stern, Jr. | 463/16 |
| 2002/0077712 | A1 * | 6/2002 | Safaei et al. | 700/93 |
| 2004/0198483 | A1 * | 10/2004 | Amaitis et al. | 463/16 |
| 2005/0148379 | A1 * | 7/2005 | Huard et al. | 463/16 |
| 2006/0084500 | A1 * | 4/2006 | Baerlocher et al. | 463/25 |
| 2007/0072668 | A1 * | 3/2007 | Hein et al. | 463/16 |
| 2008/0248850 | A1 * | 10/2008 | Schugar | 463/16 |

* cited by examiner

*Primary Examiner* — Pierre Eddy Elisca
*Assistant Examiner* — Shahid Kamal
(74) *Attorney, Agent, or Firm* — Cascio & Zervas; Anthony T. Cascio; Charles H. Jew

(57) ABSTRACT

For a race or contest in which a predetermined number of entries compete for winning position wherein for each of the entries respective predetermined odds of winning are given, a method is provided for determining a plurality of wagers wherein each of the wagers is to be placed on a respective one in a subset of the entries. In accordance with such method, initial criteria that all of the wagers must satisfy is established. Next, a maximum wager total being a sum of all of the wagers is determined. Finally, each of the wagers is calculated in accordance with the criteria and the maximum wager total.

3 Claims, 2 Drawing Sheets

PARI-MUTUEL WAGERING SYSTEM

RELATED APPLICATION DATA

The present application is entitled to the benefit of and claims priority from the commonly owned, co-pending applications for patent having at least one inventor in common herewith entitled "Pari-mutual Wagering System," Ser. No. 60/656,214, filed Feb. 25, 2005, the specification of which is incorporated herein by reference.

BACKGROUND OF THE INVENTION

In many games of chance, a player selects, based upon an initial state of the game and its rules, a final state of the game that the player believes will be the winning state. For example, in a race among various contesting entries, the player, analyzing various subjective and objective criteria, selects what the player believes will be the overall winner or the final order of some or all of the entries.

In particular, in horse racing a bettor may place bets on one or more horses in any race wherein each horse has betting odds associated therewith. The odds determine the amount of money to be returned to the bettor per unit amount bet should such horse win the race. Typically, the bettor refers to a racing sheet to obtain subjective and objective information about each horse in the race to assist in the selection of bets. Selection of bets in any one race may include bets on each of long and short odds to minimize risk and maximize gain.

SUMMARY OF THE INVENTION

The present invention is directed to a pari-mutuel wagering method and apparatus that enables a bettor to determine specific amounts to bet on each of several entries in a race in accordance with specific predetermined criteria, such as total amount to be bet and consistency of profit should any of the selected entries win. Specific implementations of the present invention include computer software applications adapted for use in horse racing, dog racing or jai-alai, among others.

In accordance with the present invention, for a race or contest in which a predetermined number of entries compete for winning position wherein for each of the entries respective predetermined odds of winning are given, a method is provided for determining a plurality of wagers wherein each of the wagers is to be placed on a respective one in a subset of the entries. In accordance with such method, initial criteria that all of the wagers must satisfy is established. Next, a maximum wager total being a sum of all of the wagers is determined. Finally, each of the wagers is calculated in accordance with the criteria and the maximum wager total.

The present invention advantageously provides that a person making a wager is no longer restricted to betting a single horse in each race or at best trying to calculate or estimate the amount to be bet on two or more horses and still make a profit. When using the wagering method of the present invention, the bettor can bet on more than one horse in each race in such a manner that if any of his selections win, he will make a profit that will be calculated and displayed before he places his wager.

Further advantages and features of the present wagering method include the capability of adding and/or subtracting or otherwise changing the identities of the entries to be bet upon, and/or the odds of each entry winning to arrive at the desired profit margin. Additionally, the present wagering method is adapted to indicate that a particular bet or set of bets should not be made if a predetermined minimum profit cannot be realized with the prospective bet or set of bets.

These and other objects, advantages and features of the present invention will become readily apparent to those skilled in the art from a study of the following Description of the Exemplary Preferred Embodiments when read in conjunction with the attached Drawing and appended Claims.

DESCRIPTION OF THE EXEMPLARY PREFERRED EMBODIMENTS

Figure 1:
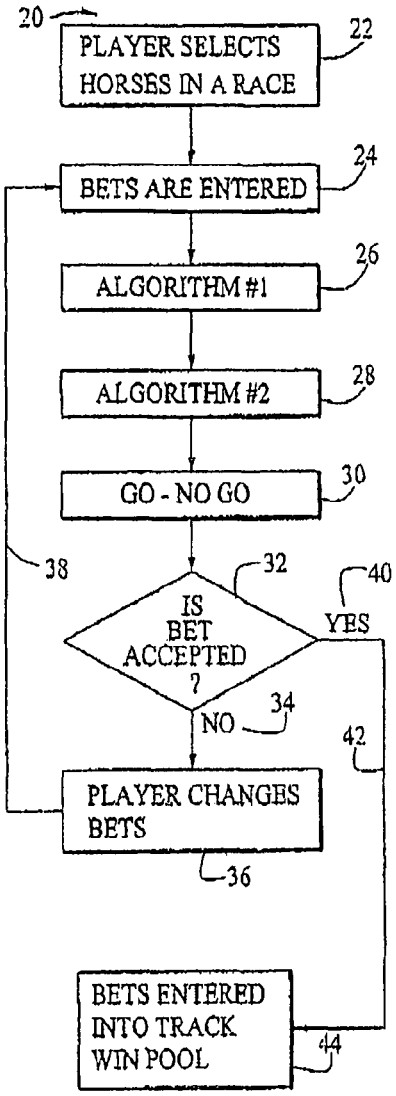
FIG. 1 is a flowchart of an exemplary method practiced in accordance with the principles of the present invention.

Referring now to FIG. 1, there is shown a flowchart 20 illustrative of an exemplary embodiment of a method practiced in accordance with the principles of the present invention. The method of the flowchart 20 may further be implemented as executable code in any conventional computing device (not shown). The code when implemented executes the below described procedures or steps described within the flowchart 20. Conventional computing devices include, but are not limited to, personal, laptop or handheld computers; and mobile electronic devices such as PDA's, calculators or cellular telephones. Furthermore, such computing devices may be a network communication over any type of public or private, local or wide area network with other computer systems that operate tote boards and race tracks in off-track matching facilities.

As indicated at step 22, a subset of entries from all entries within a race or contest on which a bet or wager is desired to be placed is selected. The selection, as well as all other data input and output procedures described herein, may be made through conventional graphic user interface of the computing device. In the exemplary embodiment of FIG. 1, the contest is shown as a horse race, although this to be understood that the contest to be any such event wherein each entry as odds calculated respectively therefore for winning the race. Other such contests include dog racing, jai alai and the like, as well as sporting events.

As indicated at step 24, the bet desired to be placed on each of the selected entries determined at step 22 is entered into or calculated by the computing device. In response to each such bet being so entered or calculated, the procedures of step 26 are implemented in accordance with $$B_x = B_T \times \frac{OD_x}{S_{OD}} + \Delta \qquad \text{(Eq. 1)}$$

wherein $B_x$ is the amount of the bet placed on the $x^{th}$ entry in the contest such that $$B_T = \sum_{l}^{x} B_x,$$

$$OD_x = \frac{1}{O_x + 1}$$

wherein $O_x$ is equal to the odds on the $x^{th}$ entry in the contest, and $$S_{OD} = \sum_{l}^{x} OD_x.$$

In the algorithm of Eq. 1, the term Δ is automatically computed such that $B_x$ is rounded to the nearest whole integer.

In, response to the procedures indicated at step 26 being completed, the procedures of step 28 are implemented in accordance with $$P_x = \frac{\frac{B_x}{OD_x} - B_T}{B_T} \times 100\% \quad \text{(Eq. 2)}$$

wherein $P_x$ is the percent profit to be realized in the event the $x^{th}$ entry with odds $O_x$ in the contest wins.

As indicated at step 30, each $P_x$ is compared to a predetermined criterion, which may further be user selected. For example, such criterion may be a minimum percent profit to be realized from placing the total amount of bets $B_T$ in the current contest. Since this predetermined profit may be the same irrespective of which of the $x^{th}$ entry in the contest is the ultimate winner, then effectively $P_x$=P. A decision is made, as indicated at step 32, to determine if the bet $B_x$ is acceptable. This determination is made in accordance whether the profit $P_x$ compares favorably or unfavorably to a predetermined criterion.

If the comparison is unfavorable, the no path is taken, as indicated at 34, and each of the bets $B_x$ currently stored in the computing device may be changed, as indicated at step 36. Additionally, when the no path, indicated at 34, is taken the graphic user interface of the computing device may further inform of the unfavorable decision made at step 32. The above described procedures and steps of the method of flowchart 20 reiterate to step 24, as indicated at 38.

Otherwise, if the comparison is favorable, the yes path is taken as indicated at 40. When the yes path, indicated at 40, is taken the graphic user interface of the computing device may further inform of the favorable decision made at step 32. The player may then place the actual bets on the selected entries, as indicated at step 44.

Figure 2:
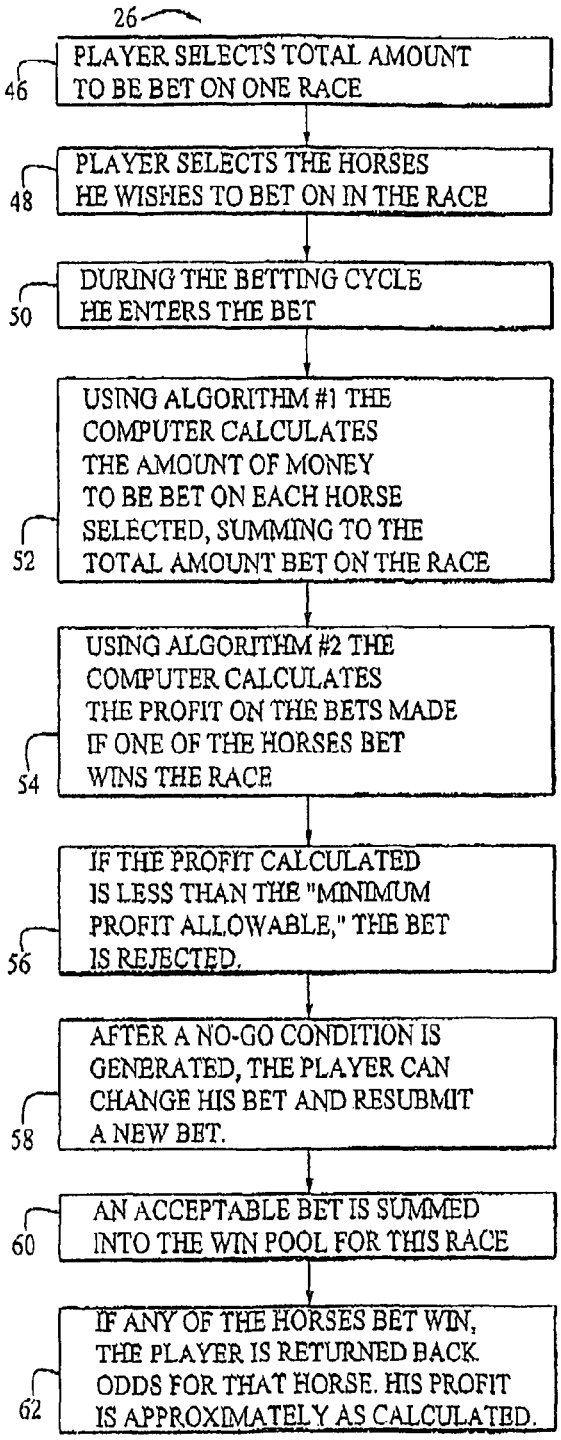
FIG. 2 is a flowchart of an exemplary preferred detailed embodiment of the method of FIG. 1.

With reference to FIG. 2, there is shown a flowchart of the process that a player may use in conjunction with the operation of the computing device in which the steps or procedures of FIG. 1 have been implemented. As indicated at step 46, a player selects the total dollar amount $B_T$ desired to be placed on all entries within a race or contest, such as two or more horses within a single horse race, and enters this total dollar amount into the computing device.

Next, as indicated at step 48, the player identifies initially the horses desired to be bet upon and enters this information into the computing device. As indicated at step 50, the odds for each of the horses entered at step 48 is also entered into the computing device. The odds $O_x$ may be manually entered by the player through the graphic user interface of the computing device or automatically through a network connection with the race track or off track betting facility computer system.

The computing device, as indicated at step 52, then implements Eq. 1, as described above at step 26 (FIG. 1) to determine each bet $B_x$ to be placed in each $x^{th}$ entry or horse in the race. Furthermore, as indicated at step 54, the computing device implements Eq. 2, as described above at step 28 (FIG. 1) to determine the total profit to be made if any one of the selected horses wins the race. As indicated at step 56, the computing device then implements each of step 30 and step 32 (FIG. 1) to determine whether the total profit meets the predefined criteria.

If the predefined criteria are not met, as indicated at step 58, the player may then change the bets and enter these new bets into the computing device, as described above at step 36 (FIG. 1). Otherwise, if the currently computed bets are acceptable, the player's actual bets are then placed on the selected horses as indicated at step 60. Finally, as indicated at step 62, if any one of the selected horses wins the player will receive the pay out at a profit approximately that as calculated by Eq. 2.

Figure 3:
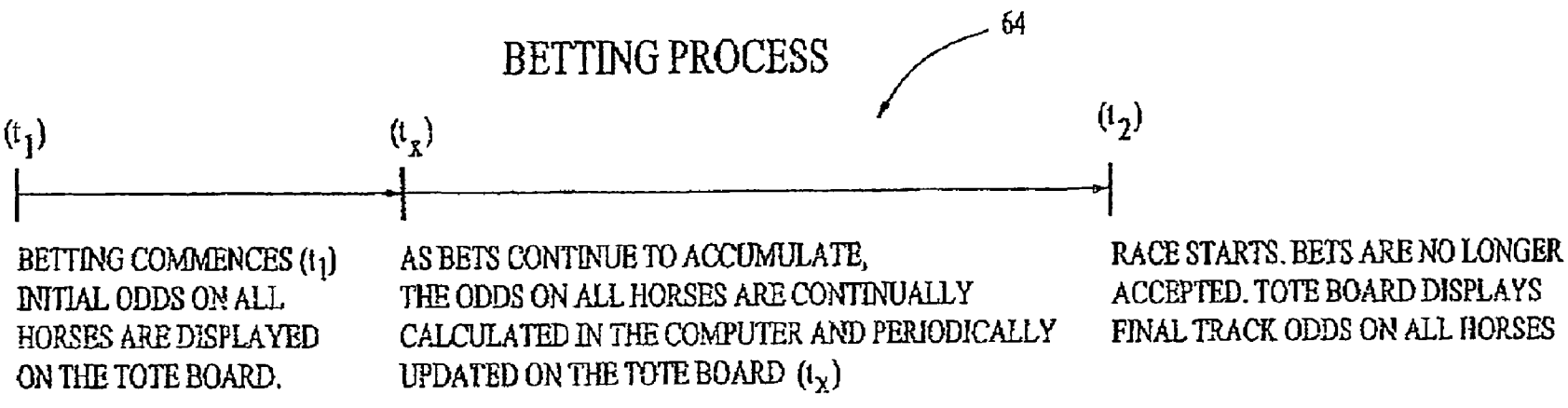
FIG. 3 is a timeline useful in practicing the method of FIG. 2.

In pari-mutuel wagering, the odds are continuously changing in accordance with the bets being placed on each entry in a race. With reference to FIG. 3, the betting process in terms of continuously updated odds is explained. It is to be noted that the actual profit calculated in the computing device will not exactly match the profit returned to the bettor because of these changing odds especially when the computing device is in network communication with the betting facility computer system.

When betting commences for a given race, at time, $T_1$, the initial odds for each horse in the race are displayed on the race track or other betting facility tote board. As time passes, the players continue to place bets on each of the horses in that race, and as the bets accumulate, the odds are continually updated. At any time, $T_x$, there will be calculated odds for each horse in the race. Finally, when betting closes, at time, $T_2$, the final odds for the race are displayed. The odds entered into the computing devise will be the odds at any time, $T_x$.

As shown in the above example the bettor enters the total amount of money he wishes to bet on that race into the computing device. Once this information is entered and a bettor instructs the device to perform the calculations, the computing device, implementing Eq. 1, will calculate and display the amount of money to be bet on each of the horses selected. Of course, the amount of each bet must total the selected total amount to be bet. In implementing Eq. 2, the computing device will calculate and display the approximate profit to be made in the event any one of the selected horses wins the race. If satisfactory, the bettor can then place his bets with the racing establishment.

At any time, through the graphic user interface the bettor can change the profit margin up or down, and additionally add, subtract or change his selections used for placing the bets. The steps and procedures of FIG. 1 can be repeatedly executed in the computing device until betting is closed. For example, if after the desired bets are entered, and the criteria are not met, the process may be re-executed with differing initial bets until such criteria are met.

As described above, the criteria is that the bettor first distributes bets across the desired entries, and a percentage profit return is calculated. A comparison is made to determine if this percentage profit for each bet meets a minimum profit or other profit criterion. If not, then the bets may be manually changed or recalculated using Eq. 1 and the above described steps reiterated. An alternative embodiment is hereinafter described.

Exemplarily, the bettor desires to place a total bet $B_T$ of \$1000 on three horses respectively having odds $O_x$ of 5/2, 6/1 and 9/1, such that the profit $P_x$ if any one of these horses wins is the same such that $P_x$=P. Having this criteria entered into the computing device, in accordance with the above described methods, it can readily be seen from Eq. 1 and Eq. 2 that the amounts to be placed on horses having odds of 5/2, 6/1 and 9/1 is respectively \$540, \$270 and \$190, such that the profit to be realized should any one of these three horses wins be 89% or \$890.

As in known in pari-mutuel betting, the odds change over time, as described above. For example if the odds for the horse at 6/1 is entered into the computing device at time, Tx, and such horse wins, the actual amount returned will be computed from the true odds at time, T2. Should the odds increase the actual return will be greater. Similarly should the odds decrease the actual return will be smaller.

In the example above, it is seen that the criteria selected is that profit margin to be realized if any of the selected entries wins is substantially constant. These criteria can be extended to other examples, for example, betting only on a selected number of those entries having either the highest or the lowest odds.

There has been described hereinabove a novel method and apparatus for a Pari-mutuel Wagering System. Those skilled in the art may now make numerous uses of, and departures from, the hereinabove described embodiments without departing from the inventive principles disclosed herein. Accordingly, the present invention is to be defined solely by the lawfully permissible scope of the appended Claims.

What is claimed as the invention is:

1. For a race or contest in which a predetermined number of entries compete for winning position wherein for each of said entries respective predetermined odds of winning are given, a method for determining a plurality of wagers wherein each of said wagers is to be placed on a respective one in a subset of said entries comprising steps of:

entering into a handheld device a maximum wager total;

downloading into said handheld device said predetermined odds;

establishing initial criteria that all of said wagers must satisfy wherein one of said criteria is a percentage rate of return on said maximum wager total that any one of said wagers must at least meet in the event said respective one of said entries with which said one of said wagers is associated wins said race or contest and further wherein said percentage rate of return is a preselected minimum rate of return for each of said wagers;

calculating each of said wagers in accordance with said criteria, said predetermined odds and said maximum wager total including the step of deriving each of said wagers such that a sum of said wagers is equal to said maximum wager total wherein each of said wagers is derived in accordance with the formula $$B_x = B_T \times \frac{OD_x}{S_{OD}} + \Delta;$$

displaying each of said wagers on a graphic user interface of said hand held device computing a percentage rate of return for each of said wagers that would be obtained in the event said respective one of said entries with which said one of said wagers is associated wins said race or contest;

comparing said computed percentage rate of return for each of said wagers to said preselected minimum rate of return; and reiterating said deriving, computing and comparing steps until said percentage rate of return for each of said wagers at least meets said preselected rate of return.

2. A method as set forth in claim 1 wherein said percentage rate of return is substantially identical for all of said wagers.

3. A method as set forth in claim 1 wherein each of said wagers is calculated in accordance with the formula $$P_x = \frac{\frac{B_x}{OD_x} - B_T}{B_T} \times 100\%.$$

* * * * *